United States Patent [19]

Nikaido

[11] 4,342,174

[45] Aug. 3, 1982

[54] FLOATING TOY

[75] Inventor: Teruo Nikaido, Tokyo, Japan

[73] Assignee: Tomy Kogyo Company, Inc., Tokyo, Japan

[21] Appl. No.: 254,966

[22] Filed: Apr. 16, 1981

Related U.S. Application Data

[62] Division of Ser. No. 151,434, May 19, 1980, Pat. No. 4,277,908.

[30] Foreign Application Priority Data

Jun. 19, 1979 [JP] Japan ..... 54-83776

[51] Int. Cl.[3] ..... A63H 23/10

[52] U.S. Cl. ..... 46/92; 46/123

[58] Field of Search ..... 46/92, 91, 93, 94, 123; 43/26.2, 42.13, 42, 42.03

[56] References Cited

U.S. PATENT DOCUMENTS

| | | | |
|---|---|---|---|
| 636,106 | 10/1899 | Biddle | 46/92 |
| 1,828,034 | 10/1931 | Einfalt | 46/92 |
| 3,798,830 | 3/1974 | Grieder | 46/92 |
| 3,835,581 | 9/1974 | Grieder | 46/92 |
| 4,068,401 | 1/1978 | Saitoh | 46/92 |

FOREIGN PATENT DOCUMENTS

| | | | |
|---|---|---|---|
| 2046603 | 3/1980 | United Kingdom | 46/92 |

*Primary Examiner*—Gene Mancene
*Assistant Examiner*—Mickey Yu
*Attorney, Agent, or Firm*—K. H. Boswell; Edward D. O'Brian

[57] ABSTRACT

A floating toy which is capable of propelling itself through a body of water has a body to which is attached a propelling member. The propelling member is pivotally mounted to the body at its center and moves backward and forward in an oscillating motion. The member includes a ridge having an essentially triangular shape in cross section which is located at the leading edge of the member. The ridge is able to cut through the water to move in a forward direction but meets with fluid resistance when moved in a rearward direction. The resistance against the ridge propels the toy through the water. The toy includes a head pivotally mounted to the body which is capable of moving in what can best be described as a nodding motion with respect to the body. A float is located in the head such that when the toy floats on the surface of the body of water the head assumes the position wherein it is tilted back toward the back of the body and when the toy is removed from the body of water the head is capable of tilting toward the front of the toy.

10 Claims, 9 Drawing Figures

112
110
108
116
114
100
102
106
92
52
52
98
90
104
54
94
88
92
96
4
130
122
120
127
126
128
4
124
70

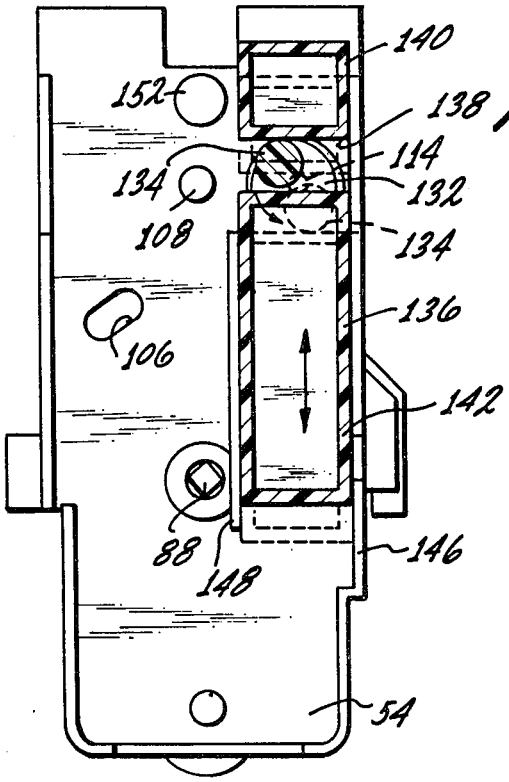
FIG. 6
FIG. 7
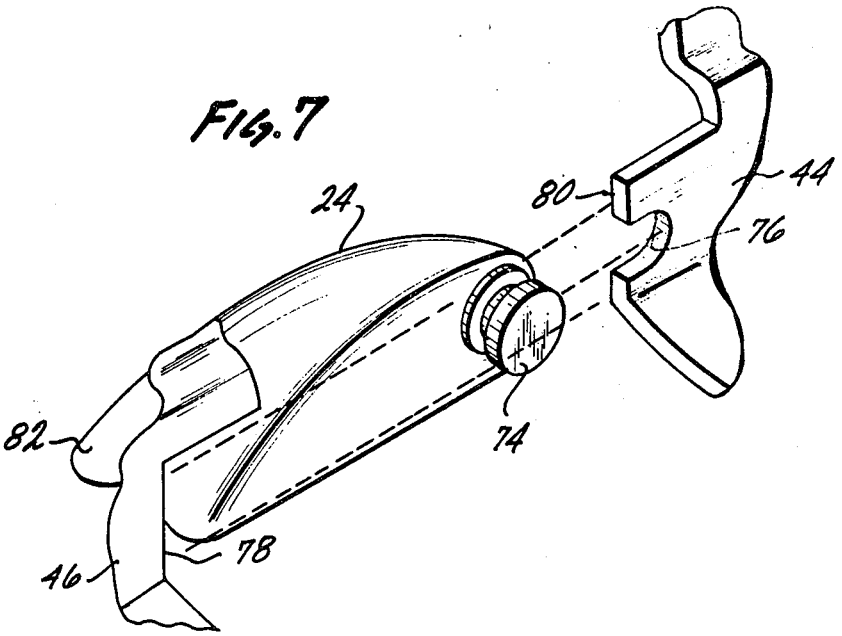

FLOATING TOY

This application is a division, of application Ser. No. 151,434, filed May 19, 1980, now U.S. Pat. No. 4,277,908, July 14, 1981.

BACKGROUND OF THE INVENTION

This invention is directed to a toy which propels itself through a body of water via an oscillatory motion of a member which is pivotally mounted to the body of the toy at its center. The member includes a ridge so shaped and placed on the member that it freely slips through the water in a forward direction but encounters fluid resistance in a rearward direction enabling it to push against the water to propel the body. The toy includes a pivotally mounted head which moves between two positions. A float within the head insures that the head assumes one of these positions when the toy is within a body of water.

A plurality of toys are known which are capable of propelling themselves through water via one of several common mechanisms. The first of these mechanisms is based upon movement of one or two flippers, feet or the like in a fluttering manner. Commonly this movement is achieved by a crank shaft or pin interacting with a connecting rod or slotted lever.

An example of the mechanism described above appears in U.S. Pat. No. 3,628,286 which is directed to an amphibian toy. A pair of webbed feet are propelled by the rotation of a crank shaft within a slotted lever. A second toy described in U.S. Pat. No. 3,332,165 utilizes a similar principle to cause the rear legs of the toy to achieve a flutter kick. In this toy the rear legs' motion is achieved via interaction of pivotal connecting rods which are joined to a crank shaft.

A second type of motion alluded to in the preceding is also presented in U.S. Pat. No. 3,332,165. This motion is exemplified by the movement of the arm portion of the figures. The arms in this patent rotate in a conical manner. Thus the ends of the arms, i.e. the hands, move in essentially a circle. Other patents such as U.S. Pat. No. 3,247,613 also describe toys wherein the arms are capable of moving in a circular manner by rotating at the shoulder about fixed bearings. In the U.S. Pat. No. 3,332,165 the conical movement of the arms is achieved by incorporation of a universal joint in each shoulder.

A third type of motion is achieved in U.S. Pat. No. 4,068,401 which utilizes oscillating legs having pivotal vanes attached to their ends. During the forward stroke the vanes pivot backward to decrease the water resistance. During the backward stroke, the propulsion stroke, the vanes become perpendicular to the plane of motion because they can pivot to the perpendicular position and be held there by a small locking pin or the like.

The flutter type kick described above is useful in toys which characterized animals or humans which are capable of propelling themselves via flippers, feet or the like. The circulating arm type of toy is essentially only useful in toys which mimic human forms because of the lack of appropriate appendages corresponding to the human arms in toys which are shaped like animals. Toys which utilize pivotal vanes or paddles, while they are capable of swimming, somewhat detract from an accurate representation of an actual animal since animals have hinged paddles on their feet.

Certain aqueous animals such as penguins and hump back whales have quite prominent upper torso flippers which they utilize while swimming. No toys are known which mimic the action of these flippers.

Many animals which are amphibious such as frogs, penguins and sea lions tend to stretch their head out in front of themselves while they are swimming to present a stream lined shape to the water, but dip or nod their head downwardly when they are on the land. No toys are known which both swim and walk and are capable of mimicking this head movement to change their head position between one for swimming and one for walking.

BRIEF SUMMARY OF THE INVENTION

In view of the above it is an object of this invention to provide a toy which is capable of moving itself through a body of water by manipulating its front flippers. It is a further object of this invention to provide a toy which is capable of movement about its neck such that its face or other prominent features of its head are extended forward while it is swimming but is also capable of movement of these same features downwardly toward its chest or stomach when it is located on a solid support, mimicking the manner of head movement of amphibious animals. Additionally it is an object to provide a toy which because of its unique engineering principles is able to provide the above noted movements utilizing mechanisms which are simple in construction thus economical to the consumer.

These and other objects as will become evident from the remainder of this specification are achieved by providing a toy capable of floating on and propelling itself through a body of water which comprises: a body; an elongated member which is generally flat and has an upper surface and a lower surface, said elongated member pivotally mounted to said body at a pivot point along its length approximately equal distance between its ends and capable of pivoting with respect to said body such that both of its ends move in an oscillatory manner back and forth within a plane, said pivot point dividing said member into left and right side portions; drive means located within the interior of said body and operatively connected to said member and capable of oscillating said member with respect to said body; both the right and left side portions of said member having a leading edge and a tailing edge positioned between the upper and lower surfaces of said member; a ridge located in conjunction with the leading edge on the lower surface of both said right and left portions of said member, said ridge being generally triangular in shape in cross section with at least one flat side which is synonymous with the bottom of the lower surface of said member and one of the angles formed by said flat side and second side of said triangular shape is an acute angle and is positioned toward the leading edge of said member and one of the angles formed by said flat edge and the third edge of said triangular shape is at least about a ninety degree angle.

Further these objects are achieved by providing a toy capable of floating on and propelling itself through a body of water which comprises: a generally stream lined body section capable of moving through water and including an outside surface generally divisible into at least a back area, a front area and left and right side areas; said back area, said front area and said left and right side areas all generally tapering inwardly toward the center of said body at one end of said body from an area having a larger cross sectional area to an area having a smaller cross sectional area to form a neck region on said body, said neck region including an opening at the end of said body wherein said neck region is located; a head section pivotally mounted to said body adjacent to said opening in said neck area and capable of pivoting with respect to said body between a first position and a second position; said head section including at least one distinguishing feature located on said head section at a point that is capable of moving through an arc that is viewable from at least one of the left or right sides of said body, said arc lying on a plane, said plane cutting through both said back and front areas of said body and when viewed from at least one of the left or right sides of said body and as measured along a curved line which is an extension of both ends of said arc, one end of said arc being located closer to said back area and the other end of said arc being located closer to said front area, said distinguishing feature located at the end of said arc closer to said back area when said head is in said first position and located at the end of said arc closer to said front area when said head is in said second position; said body section capable of floating on said body of water such that said back area is oriented upwardly with respect to the surface of said body of water; said head section including head flotation means positioned within said head section such that when said toy is floating on said body of water said head section pivots to said first position to locate said distinguishing feature at the end of said arc closer to said back area; said body including at least one movable appendage movably attached to said body section; motor means located within the interior of said body section and operatively attached to said movable appendage and capable of moving said movable appendage with respect to said body, said movable appendage propelling said toy through said body of water when said movable appendage moves with respect to said body.

Preferably the toy includes a body having a generally streamlined shape which incorporates elongated openings along the left and right side of the body. The elongated member passes through the openings such that the pivot point is located within the interior of the body and both the left and right side portions of the elongated member extends outside the body to position the ridges on the left and right hand side of the body. Preferably the transfer means includes an eccentrical rotating means and a follower means connected to the eccentrical rotating means. The follower means is operatively connected to the elongated member and transfer movement from the eccentric rotating means to the elongated member.

Preferably a head locating member extends from the interior of the body out of an opening in the neck region and into the head section through an elongated slot located on the surface of the head section. The end of the locating member located within the head section is pivotally attached to the head member allowing the head member to pivot in a nodding manner. The weight of the head section is distributed within the head section such that when the toy is not located within a body of water and the front area of the toy is oriented somewhat downwardly the head section pivots to the second position.

Flotation of the toy is augmented by including a body flotation means which is located within the body such that the toy floats with its back area upwardly. The head section can include a plurality of distinguishing features which are shaped as facial features of an animal and the toy can incorporate locomotion means capable of propelling the toy on a solid surface.

BRIEF DECRIPTION OF THE DRAWINGS

In order to facilitate understanding of this invention reference will be made to the figures wherein:

FIG. 6 is a view similar to FIG. 5 except certain components have been removed and other components are shown in section;

FIG. 7 is an exploded isometric view showing the method of attachment of certain components located near the bottom of FIG. 1;

Figure 1:
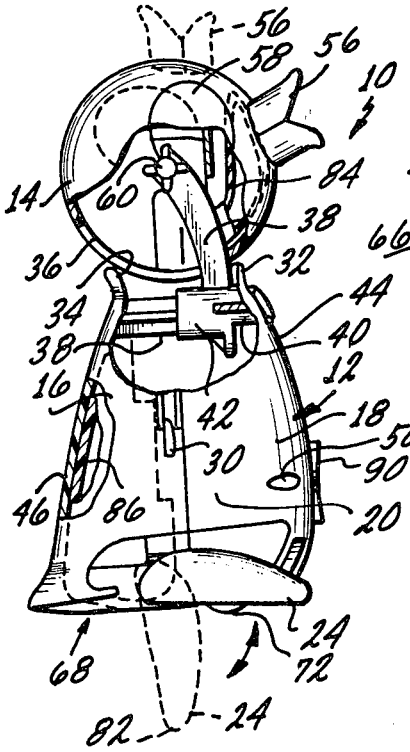
FIG. 1 is a side elevational view of the toy of the invention in partial section and showing certain of the components of the toy in a first position in solid lines and in a second position in phantom lines.

The invention illustrated in the figures and described in the specification utilizes certain principles and/or concepts as are set forth and defined in the claims appended to this specification. Those skilled in the arts to which this invention pertains will be cognizant that these principles and/or concepts are adaptable to embodiments differing from the exact embodiment described herein, but still utilize the same principles and concepts as defined by the claims. Therefore this invention is to be construed in light of the claims appended hereto and is not to be construed as being limited to only the exact embodiment herein described and shown.

DETAILED DESCRIPTION

The toy 10 of the invention is shaped as a characterized penguin. The penguin is a representative example of an amphibious animal capable of both terrestrial and aqueous locomotion. It has a characteristic waddle upon the land but is a sleek swimmer in the water. The toy 10 of the invention mimics both of these actions utilizing a single propulsion force or drive means, hereinafter described, which propels it both through the water and across a hard surface. Additionally as with many amphibious animals when in the water the penguin's head is oriented slightly different with respect to its body than it is when it walks on land. On the land the penguin assumes a somewhat upright stance tipping its head forward much like primates. In water the penguin's head is directed forward of its sleek body such that the combined unit of the head and body presents a stream lined shape which efficiently moves through the water with a minimum of resistance.

The toy 10 has a body section 12 and a head section 14. The body section 12 can be characterized as having a back area 16, a front area 18, left side 20 and right side 22. Pivotally mounted near the base of the right and left side 20 and 22 are right and left rear feet 24 and 26 respectively. Projecting out of the right and left sides are right and left flippers 28 and 30. A neck area 32 is located below the head 14 and includes an opening 34.

The back, front, right and left body areas generally taper down from the main portion of the body to the neck portion 32. Thus, the neck portion 32 located near opening 34 has a smaller cross sectional area than other portions of the body located toward the lower body torso. The head 14 is attached to the body, as hereinafter explained, such that a portion of it is essentially centralized in and hidden within opening 34.

In the back of the head there is an elongated slot 36. Projecting from within the interior of the body 12 through the opening 34 is a head locating member 38. The head locating member 38 is fixedly attached to the interior of the body via an appropriate boss 40 located within the body which fits within a cup 42 located on the end of head locating member 38.

The body 12 per se is made up into two sections, front body member 44 and rear body member 46. Cup 42 fits over the boss 40, which is integrally formed with a front body member 44, and is held there by a second boss 48, integrally formed with rear body member 46. A housing 52 and housing cover 54 are likewise fixedly held between the front and rear body members 44 and 46. The front and rear body members 44 and 46 are appropriately held together by screws, not identified or shown, which fit into appropriate openings such as opening 50 which leads to appropriate holes, not identified or shown, in front body member 44 which line up with appropriate bosses not identified or shown, in rear body member 46.

A plurality of distinguishing features are located on the head 14. These include the bill 56 and the two eyes collectively identified by the numeral 58. The head 14 is pivotally attached to the head locating member 38 via two small identical axles 60 (only one of which is shown in the drawings) formed as a part of locating member 38 which fit within appropriate bearings (not shown or identified) within the interior of the head 14. The bearings are centralized within the spherical head 14 such that the head essentially rotates within the opening 34 in the neck 32.

The head rotates between two positions. These positions are governed by the limit of travel of the head locating member 38 within the elongated slot 36. In the first of these positions the bill 56 and eyes 58 are located as is shown in phantom lines in FIGS. 1 and 2. In the second of these positions the bill 56 and the eyes 58 are shown in solid lines in FIG. 1 (they are hidden in FIG. 2 because of the back view shown in FIG. 2). The first position, that shown in phantom in FIG. 1 corresponds to the orientation of the head 14 when the toy 10 is floating in water and the second position corresponds to the position of the head 14 when the toy is resting in an upright position on a solid surface.

Using the bill 56 as an orientation point it can be seen that the bill 56, in moving between the first and second positions, moves through an arc. When viewed from the side as in FIG. 1 this arc (which, for illustrative purposes only, could be considered as being the outside surface of the head 14 between the 12 o'clock and approximately the 2 o'clock positions with the end of the arc at the 12 o'clock and 2 o'clock positions, respectively) lies in a plane (which is represented by the plane of the drawing) and this plane passes through both the front and back areas 18 and 16 of the body 12 of the toy. If the ends of the arc were extended arcuately such that the arc formed a circle or near circle (which again, for illustrative purposes only, could be considered the remainder of the outside surface of the head 14) it is evident that in the second position wherein the bill is shown in solid lines in FIG. 1, the bill 56 is located at that end (the 2 o'clock position) of the arc which is closest to the front section 18 and in the first position wherein the bill 56 is shown in phantom lines in FIG. 1, the bill 56 is located at the end (the 12 o'clock position) of the arc located closest to the back area 16.

Figure 8:
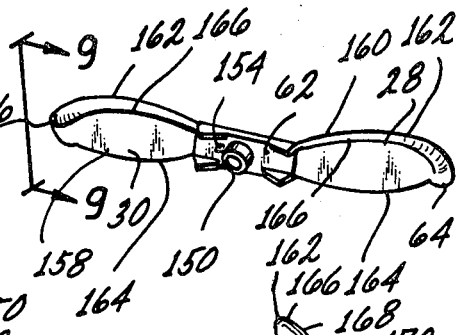
FIG. 8 is an isometric view of a component of the invention which forms the flippers of the toy.

Referring now to FIG. 8, an elongated member 62 has both the right and left flipper 28 and 30 formed on it. The elongated member 62 is mounted within the body and moves within the body, as hereinafter described, it being sufficient to say at this point that it oscillates such that the end 64 of right flipper 28 and the end 66 of left flipper 30 are capable of moving up and down. Extending out of the bottom 68 of the toy 10 are two eccentrically mounted wheels 70 and 72. These wheels are driven by the same drive mechanism, as hereinafter explained, as is elongated member 62. The wheels 70 and 72 project out of slots (not shown or numbered) in bottom 68 and are located just inside of right and left rear feet 24 and 26. The eccentricity of the mounting of the wheels is such that one of the wheels 70 or 72 will extend out of the bottom 68 at one period of time to a greater extent than the other of the wheels will and after the common axle, hereinafter identified and numbered, on which they are mounted rotates 180 degrees the other of the wheels will extend further than the first wheel.

Figure 2:
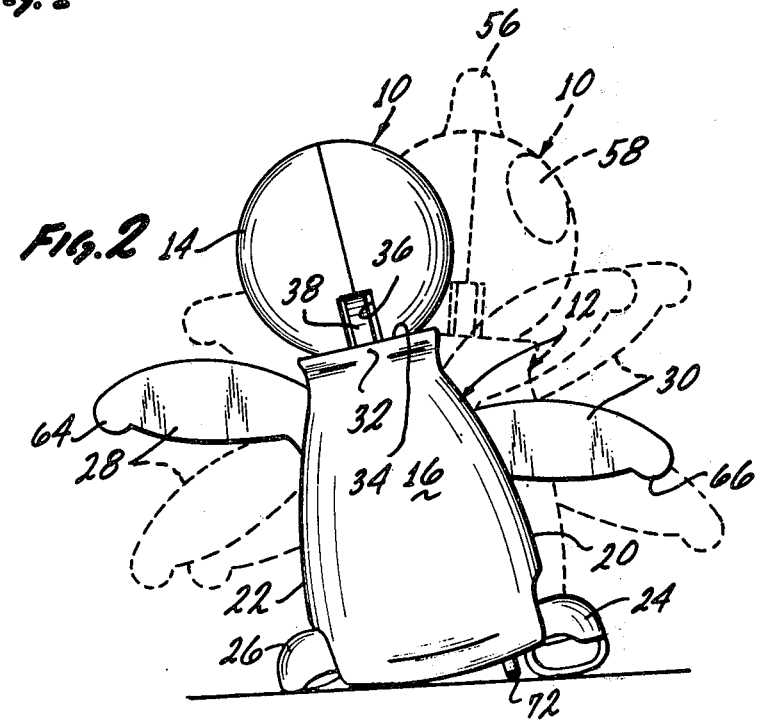
FIG. 2 is a rear elevational view of the toy showing the toy in a plurality of configurations in both solid and phantom lines to illustrate the manner of movement of certain of the components of the toy.

Referring to FIG. 2, as the wheels 70 and 72 rotate their eccentric mounting causes the toy 10 to sway back and forth when viewed from either the back or the front. Two of the positions during this swaying movement are depicted in FIG. 2 in solid and phantom lines. This motion mimics the motion of the waddle of a penguin.

Referring now to FIGS. 1 and 7, each of the right or left rear feet 24 and 26 contain identical slotted bosses 74 on one end. The slotted bosses 74 fit within appropriate cutouts 76 in front body member 44. The bosses 74 are retained within the cutouts 76 by a portion 78 of the surface of rear body member 46 which fits flush against surfaces 80 of front body member 44 when these two body members are joined as previously described. The slot (not separately numbered) in slotted bosses 74 is smaller than the cutout 76 allowing the rear feet 24 and 26 to freely pivot about the bosses 74 in cutout 76. This pivoting motion is depicted in solid and phantom lines in FIG. 1 for foot 24. Likewise foot 26 is free to pivot. As the toy 10 waddles during movement along a solid surface, the feet 24 and 26 pivot about their attachment to the body 12 maintaining the front or toe portion 82 of the feet 24 and 26 in contact with the surface at all times. This further contributes to the realistic effect of the terrestrial movement of the penguin shaped toy 10.

Concurrently with the waddle depicted in FIG. 2 the right and left side flippers 28 and 30 move up and down in an oscillatory manner as is depicted in the plurality of phantom lines. This oscillatory movement of the right and left flippers 28 and 30 contributes to the normal comical appearance of the penguin shaped toy 10 during terrestrial movement as is common in real penguins, however, as herein after explained, the oscillatory movement of the flippers 28 and 30 successfully propels the toy 10 when it is floating in a body of water. The oscillatory movement is within the longitudinal (vertical in FIG. 2) plane of the toy 10.

While not a part of the waddling terrestrial movement, the solid and phantom positions of the head 14 shown in FIGS. 1 and 2, show the appropriate movement of the head 14 between its first and second position. As noted previously the first position, shown in phantom in these figures, is the position assumed by the head 14 when the toy is floating in water and the second position, shown in solid lines, is the position assumed when the toy is in an upright position on a surface. The weight of the bill 56 and of a floating chamber 84, discussed below, generally biases the head toward the second position when the toy is in an upright position or when the front area 18 is directed downwardly but the toy is not floating in water.

Located within the interior of the head 14, in that hemisphere of the head wherein the bill 56 is located, is the head flotation chamber 84. The flotation chamber 84 is a hollow structure easily formed of a material such as a polyethylene which is water tight and contains a quantity of gas such as air. A second flotation chamber, the body flotation chamber 86, is located within the interior of the body 12 positioned adjacent to the back area 16. It too is a hollow body constructed as per the construction of the other chamber 84. When the toy 10 is floating in water, the presence of the body flotation chamber 86 insures that the toy will be oriented with respect to the water such that the back area 16 is directed upwardly. If at this time the head 14 is in the second position it will automatically be pivoted to the first position because of the presence and location of the buoyant head flotation chamber 84. It will be maintained in this first position as long as the toy 10 is floating in the body of water.

Figure 3:
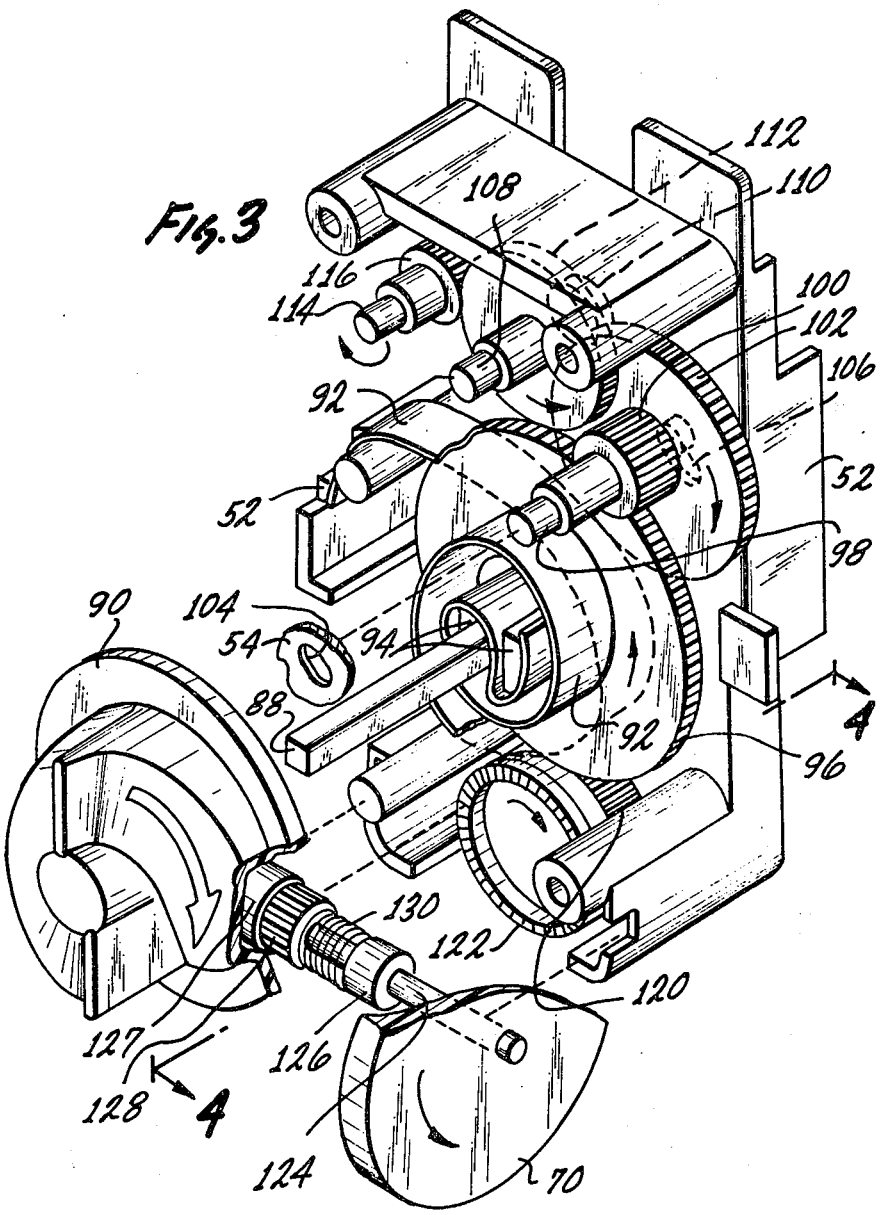
FIG. 3 is an isometric view partially exploded and partially cut away to show details of the propulsion mechanism of the toy.
Figure 4:
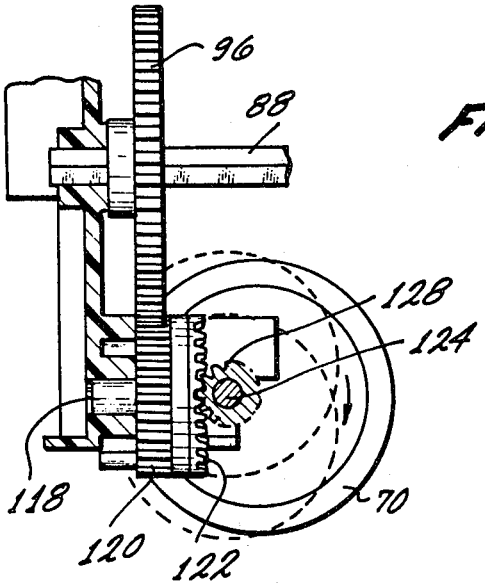
FIG. 4 is an elevational view in partial section about the line 4—4 of FIG. 3.

The propulsion means or motor of the toy 10 is depicted in FIG. 3. It consists of a main shaft 88 which is appropriately journaled in both housing 52 and housing cover 54. A portion of shaft 88 extends through housing cover 54 and winding knob 90 is fixedly attached to this shaft. Winding knob 90 is exposed through the front body member 44 such that it can be utilized by the user of the toy to wind the motor. Coiling around the shaft 88 is a spiral coil spring 92. The inside end of the spring 92 is wrapped around two projecting lugs collectively identified by the numeral 94 which project upwardly from the surface of spur gear 96. Spur gear 96 is fixedly attached to shaft 88. The other end of spring 92 is attached to housing 52. When the winding knob 90 is turned clockwise, as viewed in FIG. 3, this motion turns shaft 88 and spur gear 96 and coils spring 92 tightly about shaft 88 tensing it. Under the influence of the tension thus incorporated into spring 92 during the winding it will uncoil itself driving both shaft 88 and spur gear 96 counterclockwise as view in FIG. 3.

An axle 98 has a pinion 100 and a spur gear 102 fixedly attached to it. Axle 98 is appropriately journeled in slotted bearings 104 and 106 located respectively in housing cover 54 in housing 52. Axle 98 is free to slide up and down within these bearings 104 and 106; however, at all times pinion 100 meshes with spur gear 96. Located to the left of axle 98 is axle 108, which is approximately journaled in bearing surfaces, not numbered or shown, in housing 52 and housing cover 54. Fixedly attached to axle 98 are pinions 110 and spur gear 112.

When the winding knob 90 is being turned clockwise coiling or tensing the spring 92 this motion is imparted via spur gear 96 to pinion 100 which moves axle 98 clockwise. This locates the axle 98 in the lower right hand portion of bearings 104 and 106 as viewed in FIG. 3. When this happens spur gear 102 is positioned such that it will not mesh with pinion 110. When shaft 88 and spur gear 96 are allowed to rotate counterclockwise during the tensing or uncoiling of spring 92, the interaction of spur gear 96 with pinion 100 forces axle 98 counterclockwise (upwardly and to the left in the bearing surfaces 104 and 106 in FIG. 3). This engages spur gear 102 with pinion 110 such that axle 108 rotates in unison with shaft 88 and axle 98.

Located to the left of axle 108 is axle 114 which has pinion 116 fixedly attached to it. Pinion 116 meshes with spur gear 112 and thus axle 114 rotates whenever axle 108 rotates. Ultimately the train of gears thus described results in rotation of axle 114 whenever the spring 92 is uncoiling or untensing however, during coiling or tensing of this spring movement of axle 98 disrupts the chain of gears and thus axle 114 does not turn.

Located below shaft 88 is an axle 118 which has a combined gear having spur teeth 120 and crown teeth 122 located thereon. Spur teeth 120 mesh with spur gear 96 to turn this gear. Since spur teeth 120 and crown teeth 122 are carried on the same gear, whenever spur gear 96 rotates this rotation is also imparted to crown teeth 122. Wheel axle 124 is appropriately journaled in housing 52. Wheels 70 and 72, introduced previously, are eccentrically attached to this axle. In the center of wheel axle 124 is a bushing 126 which is fixedly mounted to axle 124. A second bushing 127 identical to bushing 126 is also fixedly located on axle 124. Located around axle 124 but not attached to it and located next to bushing 127 is pinion 128. A spring 130 between bushing 126 and pinion 128 biases pinion 128 against bushing 127. Pinion 128 meshes with crown teeth 122. The presence of spring 130 frictionally engages pinion 128 against bushing 127 and thus transfers rotation of pinion 128 to axle 124. If, for any reason, wheels 70 or 72 are not free to rotate the frictional engagement of pinion 128 with bushing 127 is overcome by the locking of the wheels 70 or 72 and the rotary motion between the axle 124 and the pinion 128 is not transferred. This mechanism thus serves as an overriding clutch to prevent damage to any of the components it is associated with should one or the components be turned and the other one not.

Figure 5:
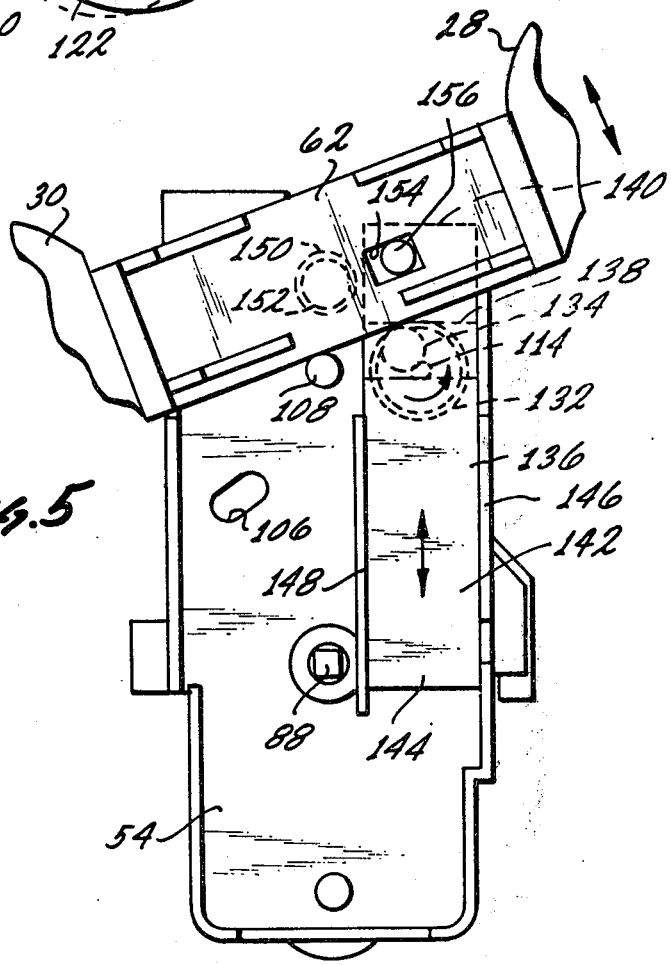
FIG. 5 is a plan view of certain of the components of the toy located within the body of the toy shown in FIG. 1.

Axle 114 extends through housing 52 and is slotted along this extension as is shown in FIG. 5. A small crank disk 132 has an appropriate slotted hole in its center such that it can fit over the extension of axle 114 and be located with respect to rotation to axle 114. A crank pin 134 extends upwardly from crank disk 132. A sliding member 136 has a slot 138 formed in its lower surface which fits over crank pin 134. The slot 138 is formed via the walls of an upper rectangular boss 140 and a lower rectangular boss 142 which extend downwardly from the flat planar surface 144 of sliding member 136. These can be seen in FIGS. 5 and 6. A first guide ridge 146 and a second guide ridge 148 extend upwardly from the surface of housing 52. Sliding member 136 fits within these guide ridges and is free to slide back and forth on the surface of housing 52. As shown in FIG. 6 as crank pin 134 turns between the positions shown in solid and phantom lines the sliding member 136 moves back and forth between the positions shown in solid and phantom lines.

Referring to FIG. 8, elongated member 62 has a hollow upstanding boss 150 located in its center. This boss 150 forms a pivot point for the member 62. In effect the boss 150 serves as a bearing. It fits over an upstanding axle 152 formed on the surface of housing 52. Thus, member 62 pivots about axle 152. Referring to FIG. 5, located to the right of axle 152 is a rectangular slot 154. Projecting upwardly from the planar surface 144 of sliding member 136 is a linking pin 156. Linking pin 156 fits within slot 154. Crank disk 132, crank pin 134, sliding member 136 and linking pin 156 serve as a motion transfer means between the spring motor and the elongated member 62. Crank pin 134 rotates eccentrically with respect to rotation of axle 114 and sliding member 136 acts as a follower means with crank pin 134. The slot 154 and linking pin 156 act as pivotal linking means between the sliding member 136 and the elongated member 62. In response to rotation of axle 114, i.e. ultimately rotation of shaft 88 under the influence of spring 92, crank pin 134 rotates and in doing so moves sliding member 136 back and forth on the surface of housing 52. The sliding motion is transferred to the elongated member 62 by the linking means causing it to oscillate back and forth about axle 152.

Figure 9:
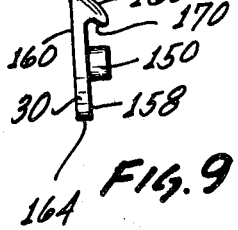
FIG. 9 is a side elevational view at the line 9—9 of FIG. 8.

Referring to FIGS. 8 and 9, elongated member 62 is symmetrical about boss 150 except for slot 154 and is a generally flat elongated component having a lower surface 158 and an upper surface 160 in both of its flippers 28 and 30. Each of the right and left flippers 28 and 30 have a leading edge 162 and a tailing edge 164. Extending along or near leading edge 162 of each of the flippers 28 and 30 is a ridge 155 which is triangular in cross section. One of the sides of this cross sectional triangle is, in fact, a portion of lower surface 158. A second side 168 meets lower surface 158 at an acute angle along the leading edge 162. A third side 170 meets lower surface 158 at approximately 90 degrees. This angle could be slightly greater than 90 degrees, but it should not be much less than 90 degrees in order for it to perform its function to assist in propelling the toy 10 through the water.

When elongated member 62 oscillates back and forth and the toy 10 is floating in the water, the leading edges 162 cut through the water during the forward movement of the particular flipper 28 or 30 and the tailing edges 164 cut through the water during the rearward movement. Since the front area 18 of the body 12 is directed downwardly when the toy 10 is floating in the water the ridges 166 are also downwardly directed and the flippers are oscillating in a plane coplanar with the surface of the water. When the leading edges 162 are being pushed forward the acute angle formed by the second side at the leading edges 162 smoothly cut through the water. During a backward movement when the tailing edges 164 are cutting through the water, the 90 degree angle or approximate 90 degree angle formed between the third sides 170 and the lower surfaces 158 effectively position the third sides 170 perpendicular to the plane of motion of the flippers 28 and 30 such that the third sides 170 resist being pushed through the water because of the fluid friction. The third sides 170 therefore are effectively held from moving through the water and the backward movement of the flippers 28 or 30 is transferred through the elongated member 62 into a forward movement of the toy 10 through the water. Third sides 170 thus resist being pushed through the water while the second sides 168 because of their angle can effectively cut through the water. This allows the oscillatory movement of the right and left flippers 28 and 30 to propel the toy through the water.

I claim:

1. A toy capable of floating on and propelling itself through a body of water which comprises:

a body;

an elongated member which is generally flat and has an upper surface and a lower surface, said elongated member pivotally mounted to said body at a pivot point along its length approximately equal distance between its ends and capable of pivoting with respect to said body such that both of its ends move in an oscillatory manner back and forth within a plane, said pivot point dividing said member into left and right side portions;

drive means located within the interior of said body and operatively connected to said member and capable of oscillating said member with respect to said body;

both the right and left side portions of said member having a leading edge and a tailing edge positioned between the upper and lower surfaces of said member;

a ridge located in conjunction with the leading edge on the lower surface of both said right and left portions of said member, said ridge being generally triangular in shape in cross section with at least one flat side which is synonymous with the bottom of the lower surface of said member and the angle formed by the flat side and a second side of said triangular shape is an acute angle and is positioned toward the leading edge of said member and the angle formed by said flat side and the third side of the triangular shape is at least about a ninety degree angle.

2. The toy of claim 1 including:

motion transfer means at least a portion of which is slidably mounted on said housing and reciprocally moving with respect to said housing, said motion transfer means operatively connected to both said drive means and said elongated member to transfer motion from said drive means to said elongated member to oscillate said member with respect to said body.

3. The toy of claim 2 wherein:

said body is capable of floating on said body of water such that said lower surface of said elongated member is directed downwardly with respect to the surface of said body of water.

4. The toy of claim 3 wherein:

said body is a generally streamlined body capable of moving through water and including an outside surface generally divisible into at least a back area, a front area and left and right side areas, said body including elongated openings along both said left and said right side areas;

said pivot point in said elongated member located within the interior of said body and said left and right side portions of said elongated member extending out of said body through said elongated slots on the left and right side of said body respectively such that said ridges on both said left and said right side portions of said elongated member are located external said body.

5. The toy of claim 4 wherein:

said motion transfer means including an eccentric rotating means, and a follower means;

said eccentric rotating means operatively connected to said drive means and capable of being rotated by said drive means;

said follower means comprising said portion of said motion transfer means slidably mounted in said housing, said follower means operatively connected to said elongated member and capable of moving with respect to movement of eccentric rotating means and transferring movement of said eccentric rotating means to oscillate said elongated member.

6. The toy of claim 5 including:

a motor housing located within the interior of said body, said drive means located in said motor housing;

an axle means located within the interior of said body, said elongated member including bearing means located at said pivot point, said bearing means mounting said elongated member to said axle means;

said follower means comprising a sliding member slidably mounted on said housing and slidable in a back and forth motion with respect to movement of said cam means;

a first pivotal linking means located on said elongated member to one side of said bearing means, a second pivotal linking means located on said sliding member, said first pivotal linking means operatively connected to said second pivotal linking means such that said back and forth sliding motion of said sliding member is transferred to oscillatory motion of said elongated member.

7. The toy of claim 6 wherein:

said eccentrical rotating means comprises a crank disk having a crank pin located on said crank disk and operatively connected to said drive means such that said crank pin is rotated eccentrically by said drive means;

said sliding member including a crank pin receiving slot, said crank pin fitting into said crank pin receiving slot to impart a back and forth motion to said sliding member with respect to rotary motion of said crank disk.

8. The toy of claim 7 wherein:

said drive means includes a spring motor and a train of gears, said crank disk operatively connected to said train of gears such that said crank disk is rotated by said train of gears in response to rotation of said train of gears by said spring motor.

9. The toy of claim 8 wherein:

said train of gears includes clutch means to disengage said train of gears from said crank disk when said spring motor is energized and to reengage said train of gears with said crank disk when said spring motor is deenergized.

10. The toy of claim 6 including:

a solid surface locomotion means capable of contacting a solid surface when said toy is placed on a solid surface and propelling said toy across said solid surface.

* * * * *